US006070372A

United States Patent [19]

Norman et al.

[11] Patent Number: 6,070,372

[45] Date of Patent: Jun. 6, 2000

[54] AUXILIARY FOLD-OUT ROOM

[75] Inventors: Daniel P. Norman, Parkland; Alan Wayne Rinderknecht, St. Augustine, both of Fla.

[73] Assignee: Bellsouth Corporation, Atlanta, Ga.

[21] Appl. No.: 09/082,041

[22] Filed: May 20, 1998

Related U.S. Application Data

[60] Provisional application No. 60/071,686, Jan. 16, 1998.

[51] Int. Cl.[7] ..... E04B 1/344

[52] U.S. Cl. ..... 52/71; 52/36.2; 52/36.4; 52/69; 296/26

[58] Field of Search ..... 52/36.2, 36.4, 52/69, 710, 643; 296/26, 27

[56] References Cited

U.S. PATENT DOCUMENTS

| | | | |
|---|---|---|---|
| 131,114 | 9/1872 | O'Brien . | |
| 1,919,986 | 7/1933 | Powers . | |
| 2,568,009 | 9/1951 | Johnson . | |
| 3,195,190 | 7/1965 | Malo . | |
| 3,226,890 | 1/1966 | Flajole . | |
| 3,633,324 | 1/1972 | Cuylits | 52/66 |
| 4,689,924 | 9/1987 | Jurgensen | 52/67 |
| 4,912,892 | 4/1990 | Jurgensen | 52/69 |

*Primary Examiner*—Carl D. Friedman
*Assistant Examiner*—Yvonne M. Horton
*Attorney, Agent, or Firm*—Jones & Askew, LLP

[57] ABSTRACT

An enclosure with an adjacent auxiliary fold-out room is useful as a utility building for cellular telephone equipment. The auxiliary fold-out room is selectively positionable in a collapsed configuration and alternatively positionable in a expanded configuration. In the collapsed configuration the auxiliary fold-out room lies against the enclosure and in the expanded configuration, panels of the auxiliary fold-out room define an enclosed space adjacent an access opening of the enclosure and provide cover for maintenance personnel while servicing equipment within the enclosure.

25 Claims, 4 Drawing Sheets

AUXILIARY FOLD-OUT ROOM

CROSS REFERENCE TO RELATED APPLICATIONS

This application claims priority under 35 U.S.C. § 119(e) of provisional U.S. patent application Ser. No. 60/071,686 entitled "Auxiliary Fold-Out Room" and filed on Jan. 16, 1998.

TECHNICAL FIELD

This invention generally relates to coverings for protection from the elements, and more particularly relates to coverings for protection from the elements while conducting maintenance on equipment in a utility enclosure.

BACKGROUND OF THE INVENTION

Cellular telephone systems require cellular telephone equipment in many locations throughout a cellular telephone service area for transmitting and receiving cellular telephone communications. Cellular telephone communication equipment is therefore installed in protective enclosures called cell sites throughout the service area. The cell sites include a secure enclosure, such as a utility building, filled with cellular telephone communication equipment such as radio equipment, transmit/receive filters, rectifiers, batteries, and the like. Cell site utility buildings are normally fully enclosed and climate controlled, usually with air conditioners to keep the equipment from overheating.

Cellular telephone equipment must be serviced from time to time and therefore, cell site utility buildings traditionally have been large enough to hold the equipment and provide sufficient space for service personnel to service the equipment from within the utility building. It is desirable, however, to minimize the size of cell sites to minimize the cost of real estate required to hold the cell site and to minimize the cost of cooling or heating the cell site. Accordingly, cell site utility buildings have been reduced in size so as to hold only the necessary equipment. Maintenance access is provided through access openings in the exterior of the cell site utility building. The access openings are sealed by a door and maintenance personnel provide maintenance from outside the utility building. One problem, however, is that maintenance personnel are exposed to the elements during maintenance of the smaller cell site utility buildings. This is a significant problem, particularly during inclement weather such as thunder storms where rain, lightening, and hail are a threat to safety.

Therefore, there is a need for a compact cell site enclosure for cellular telephone equipment which maintenance personnel can service while under cover from the elements.

SUMMARY OF THE INVENTION

The present invention satisfies the above described need by providing an enclosure with an adjacent auxiliary fold-out room. The enclosure of this invention is particularly suitable for use as a utility building for containing cellular telephone equipment. Maintenance personnel can take cover in the auxiliary fold-out room while performing maintenance on equipment inside the enclosure.

More particularly, the enclosure of this invention comprises an exterior shell defining an interior space and having an access opening for providing access to the interior space through the exterior shell. The fold-out room comprises a plurality of panels and a plurality of hinges hingedly connecting at least some of the panels to the exterior shell of the enclosure about the access opening. The panels and hinges are arranged so that the fold-out room is selectively positionable in a collapsed configuration and alternatively positionable in an expanded configuration. The panels and hinges are arranged so that, in the collapsed configuration, the panels cover the access opening of the enclosure and lie against the enclosure parallel to the access opening, and, in the expanded configuration, the panels cover the access opening and define an enclosed space adjacent the access opening and outside the adjacent enclosure.

When the enclosure of this invention is used as a cell site utility building, maintenance personnel can obtain access to the interior of the enclosure and perform maintenance on the equipment inside the enclosure by shifting the fold-out room from the collapsed configuration against the shell of the enclosure to the expanded configuration in which the fold-out room provides cover for the maintenance personnel.

Desirably, the plurality of panels of the fold-out room include a top panel, a pair of side panels and at least one rear panel, arranged so that the top panel, the pair of side panels and the at least one rear panel form a box-shape fold-out room in the expanded configuration. When shifted to the expanded configuration, the top panel provides a roof and the side panels and at least one rear panel complete the enclosure. Even more desirably, the auxiliary room includes a bottom panel which forms a floor of the fold-out room in the expanded configuration and the plurality of panels includes two rear panels for completing the enclosure.

The plurality of panels of the enclosure of this invention are desirably formed of rigid material such as aluminum, but the rear panel can be composed of a flexible material such as canvas.

When maintenance personnel are finished with maintenance of equipment within the enclosure, the auxiliary fold-out room can be shifted from the expanded configuration to the collapsed configuration and latched or locked to secure the enclosure and maintain the enclosure during normal operation at a minimum size.

Accordingly, an object of this invention is to provide an enclosure which occupies minimal space but is accessible to maintenance personnel and provides cover for maintenance personnel from the elements during maintenance.

Another object of this invention is to provide an improved utility building for cellular telephone equipment or cell sites.

Other objects, features, and advantages of this invention will become apparent from the following detailed description, drawings, and claims.

DETAILED DESCRIPTION OF EMBODIMENTS

This invention encompasses an auxiliary fold-out room for connection to an enclosure and an enclosure including one or more of such auxiliary fold-out rooms. The fold-out room provides cover adjacent the associated enclosure for protection from the elements.

The auxiliary fold-out room of this invention is particularly useful for providing cover adjacent to an enclosure comprising an exterior shell defining an interior space within the enclosure and having an access opening for providing access to the interior space of the enclosure through the exterior shell. The fold-out room comprises a plurality of panels and a plurality of hinges for hingedly connecting at least some of the panels to the exterior shell of the enclosure about the access opening. The panels and hinges of the fold-out room are arrangeable so that the fold-out room is selectively positionable in a collapsed configuration against the enclosure and alternatively positionable in an expanded configuration adjacent the enclosure. The panels and hinges of the fold-out room are arrangeable so that, in the collapsible configuration, the panels cover the access opening of the enclosure and lie against the enclosure substantially parallel to the access opening. The panels and hinges are alternatively arrangeable, in the expanded configuration, to cover the access opening of the enclosure and define an enclosed space outside the enclosure and adjacent the access opening. A detailed description of embodiments of this invention follows.

Figure 1:
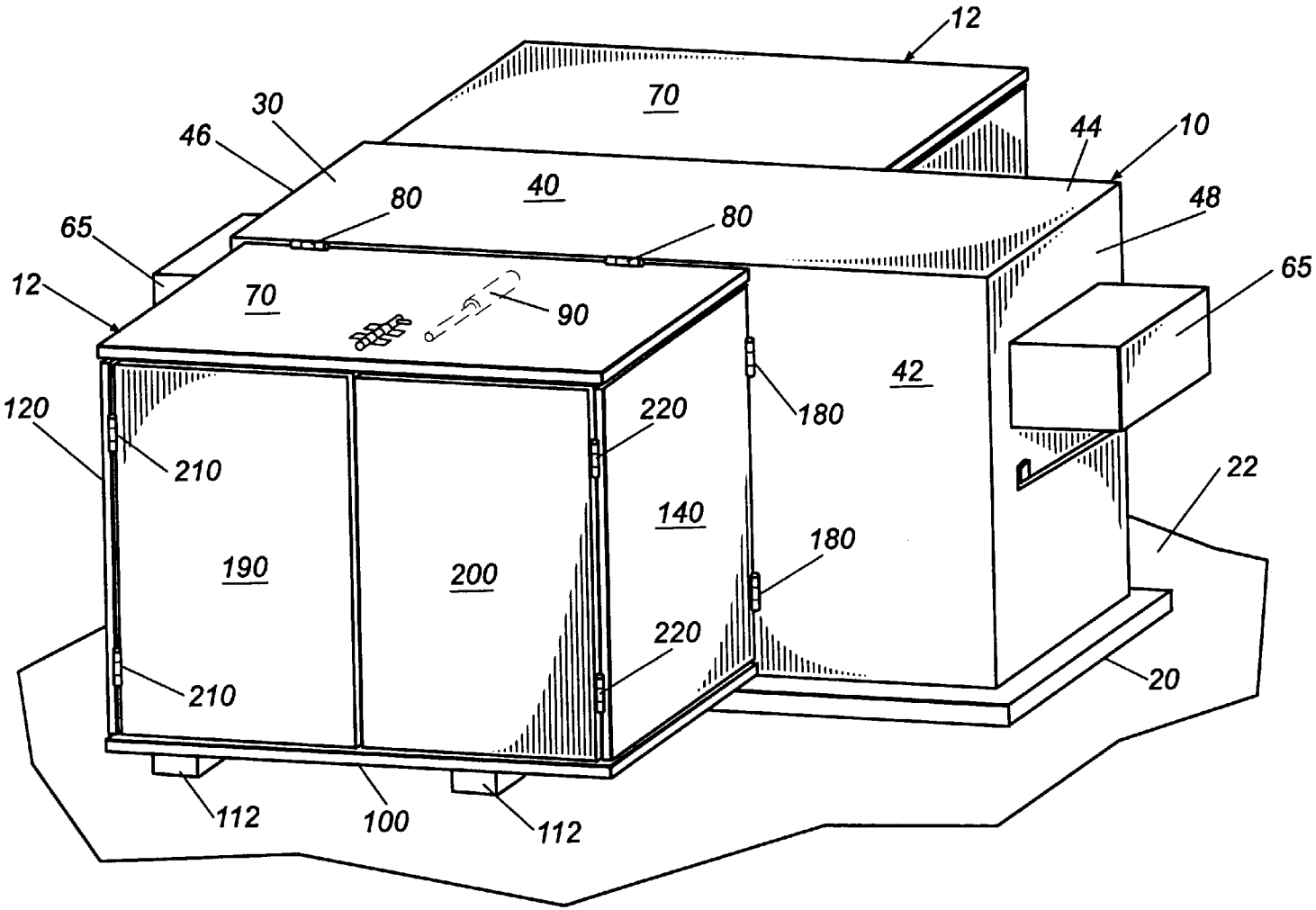
FIG. 1 is a perspective view of a utility enclosure with a pair of expanded fold-out rooms.

Turning to the FIG. 1, a utility enclosure 10 is shown with expanded fold-out rooms 12. The utility enclosure 10 is mounted on a concrete slab 20 which rests on the adjacent ground 22. The utility enclosure 10 comprises an exterior shell 30 including a plurality of walls 40, 42, 44, 46 and 48 defining an interior space 50 for housing utility equipment. The walls 40, 42, 46 and 48 of the utility enclosure 10 form a box-shaped housing including a roof 40, opposing sides walls 42 and 44 extending from the cement slab 20 to the roof and opposing end walls 46 and 48 extending from the cement slab to the roof between the opposing side walls. The side walls 42 and 44 each have a relatively large access opening 60 so that equipment within the utility enclosure 10 is accessible for repair, maintenance, replacement. Air conditioning units 65 control the climate within the utility enclosure 10.

Although FIG. 1 illustrates a utility enclosure 10, it should be understood that the fold-out room of this invention is useful for providing cover adjacent any type of building or other enclosure. The fold-out rooms are particularly useful, however, for providing cover adjacent cellular communication equipment site enclosures as will be explained in more detail below.

Figure 2:
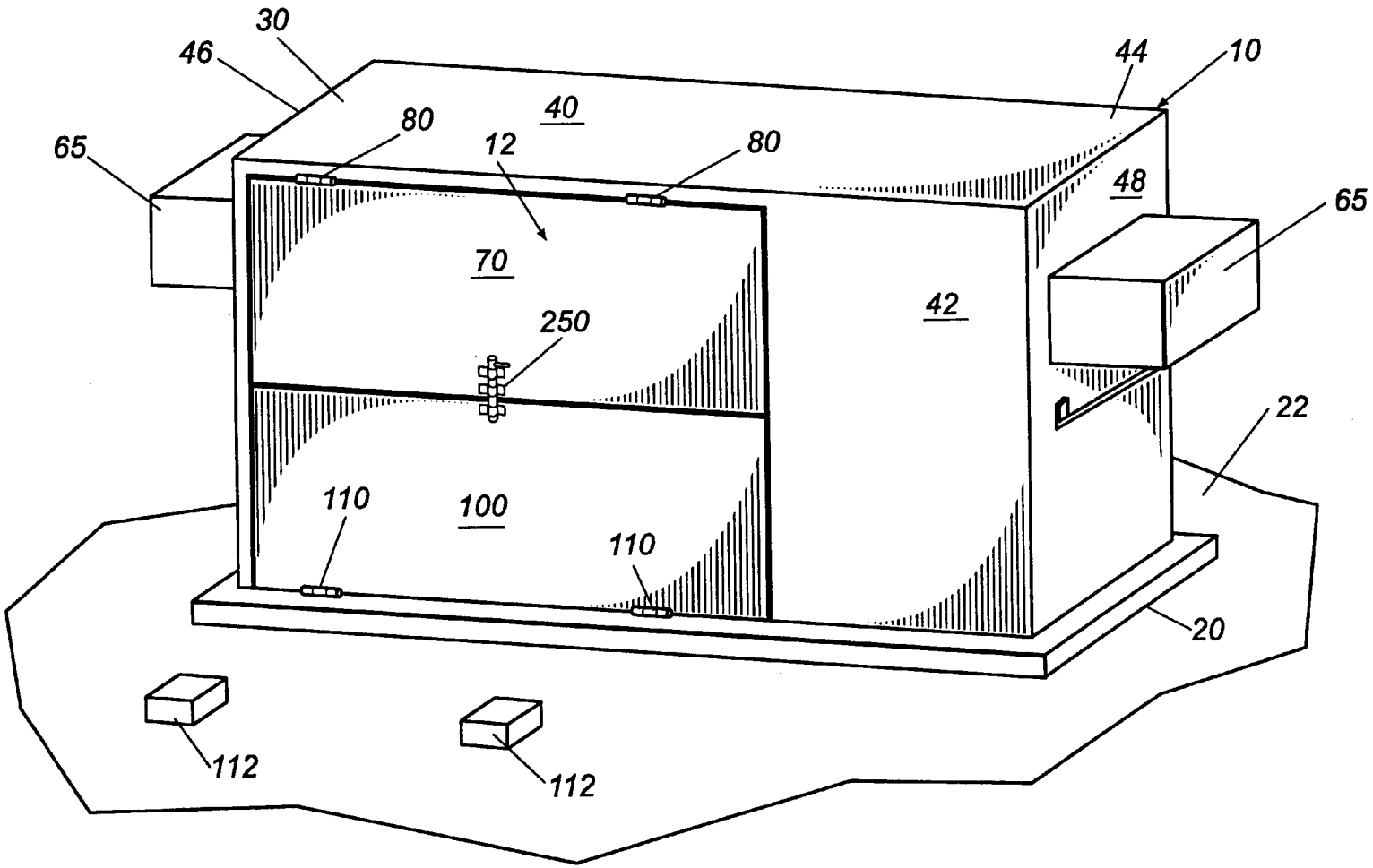
FIG. 2 is a perspective view of the utility enclosure in FIG. 1 with the fold-out room in collapsed configuration.

Each fold-out room 12 has a top panel 70 pivotally connected with hinges 80 to the adjacent side wall 42, 44 of the utility enclosure 10 above the respective access opening 60 so that the top panel can pivot from a closed position, illustrated in FIG. 2, wherein the top panel extends downwardly from above the access opening over a portion of the access opening, to an extended position, wherein the top panel extends substantially perpendicularly and outwardly from the side wall. The top panel 70 can be locked in the extended position with means such as a pneumatic cylinder 90. The top panel 70 forms an overhead cover or roof adjacent the access opening 60 of the utility enclosure 10.

Figure 3:
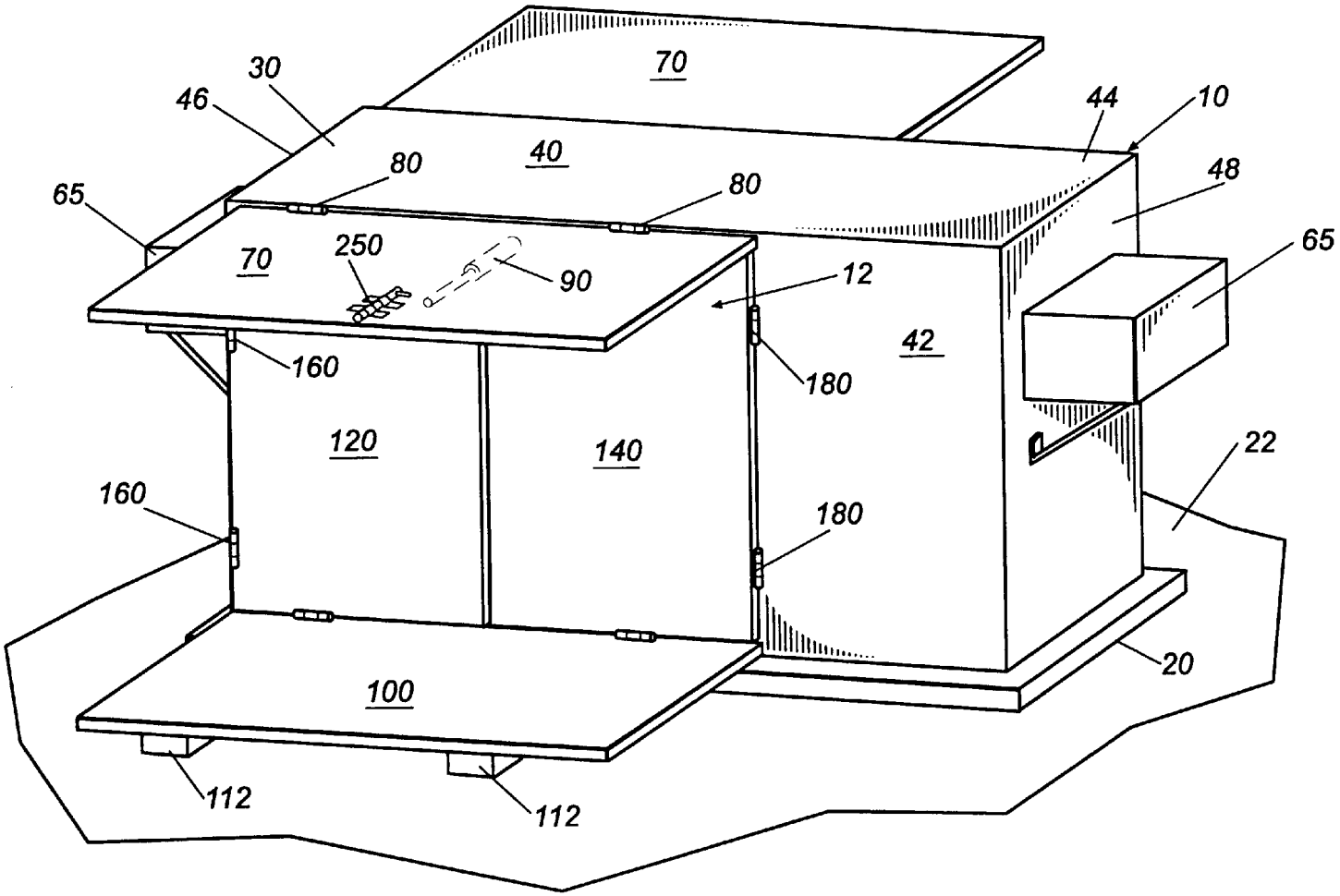
FIG. 3 is a perspective view of the utility enclosure in FIG. 1 with the fold-out room partially expanded.

A bottom panel 100, best shown in FIGS. 2 and 3, is pivotally attached with hinges 110 to the utility enclosure 10 adjacent the bottom edge of the access opening so that the bottom panel can pivot between a closed position wherein the bottom panel extends vertically over the access opening from proximate the bottom edge of the access opening and an extended position wherein the bottom panel extends outwardly and perpendicularly from the access opening and utility enclosure. Desirably, the bottom panel 100 rests on supports such as blocks set on the adjacent ground 22 in the extended position.

Each fold-out room 12 also includes side panels 120 and 140 pivotedly connected with hinges 160 and 180 to the utility enclosure 10 along respective opposing side edges of the access opening 60. The side panels 120 and 140 are mounted so as to pivot between a closed position and an extended position. In the closed position, the side panels 120 and 140 extend toward one another over the access opening and are substantially parallel with the access opening and adjacent side wall 42 of the utility enclosure 10. Desirably, the side panels 120 and 140 completely cover the access opening 60 in the closed position. In the extended position, the side panels 120 and 140 extend substantially perpendicularly and outwardly from the access opening 60 and the adjacent side wall 42 of the enclosure 10 to form a box-shaped enclosure with the top panel 70 and the bottom panel 100.

Figure 4:
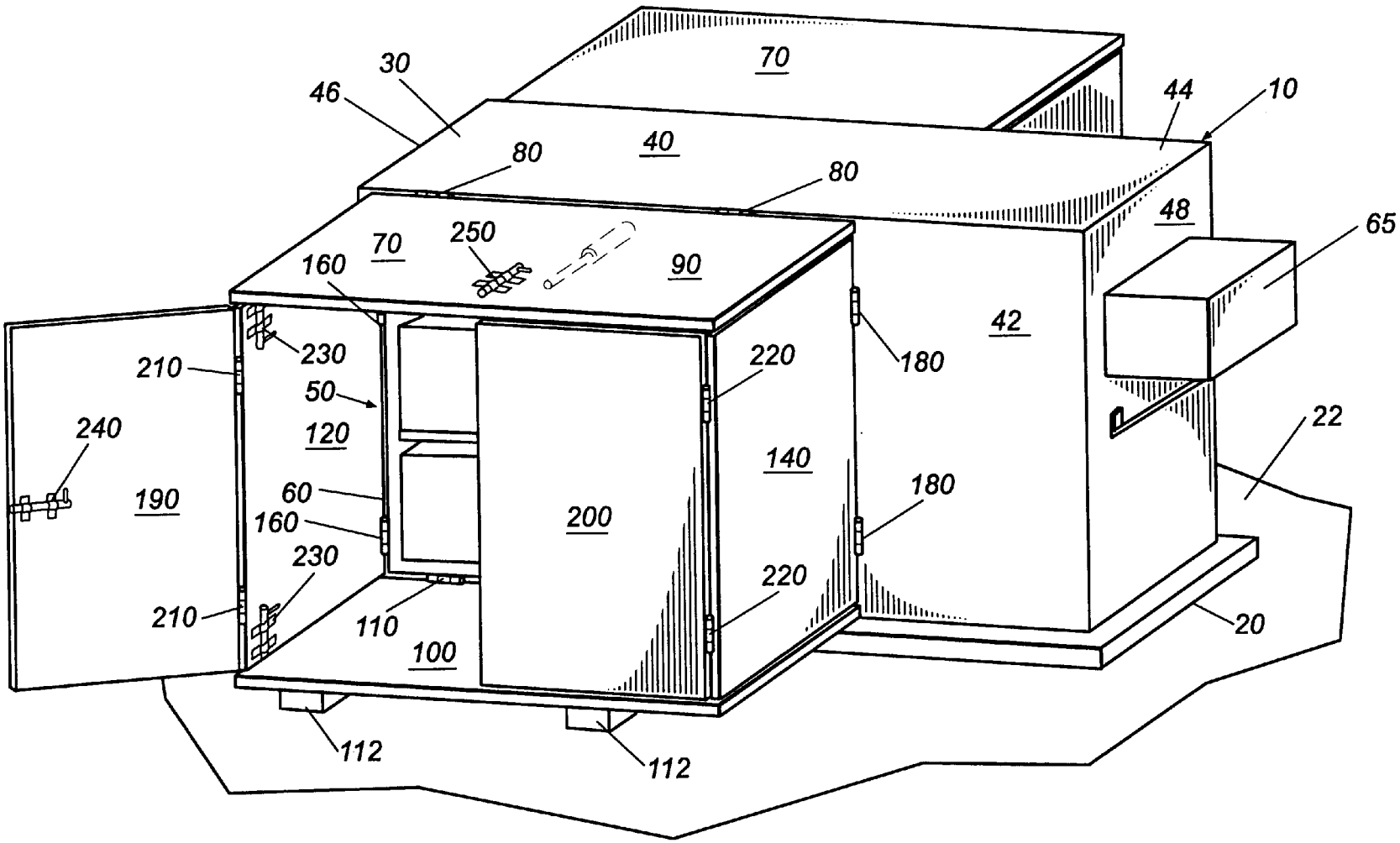
FIG. 4 is a perspective view of the utility enclosure in FIG. 1 with a fold-out room in the expanded configuration and a rear door open.

Rear panels 190 and 200 are pivotedly attached with hinges 210 and 220 to distal ends of respective side panels 120 and 140 for completing the fold-out room 12. The rear panels 190 and 200 pivot from a collapsed position to a first extended position and a second extended position beyond the first. In the collapsed position, the rear panels 190 and 200 are folded against and are parallel to the respective side panels 120 and 140. In the first extended position, the rear panels 190 and 200 extend inwardly toward one another and meet to form a rear wall of the fold-out room. In the second extended position best shown in FIG. 4, the rear panels 190 and 200 extend outwardly beyond the side panels 120 and 190 and the top and bottom panels 70 and 100 to allow access into the enclosed space defined by the walls of the fold-out room. In other words, the rear panels 190 and 200 serve as doors for ingress and egress from the fold-out room 12.

The side panels 120 and 140 can be locked in place relative to the top and bottom panels 70 and 100 with slide bolts 230 attached to the side panels. The rear panels 190 and 200 can also be secured to one another or the top and bottom panel 70 and 100 with slide bolts 240 or other similar latching devices.

The fold-out rooms 12 adjacent the utility enclosure 10 can therefore provide cover and protection from the elements while servicing equipment within the utility enclosure, but without taking up space adjacent the utility enclosure when service is not required. During normal operation of utility enclosure 10, the fold-out rooms 12 are desirably in the collapsed position, such as in FIG. 2. wherein the rear panels 190 and 200 are folded against the respective side panels 120 and 140, the side panels extend towards one another across the access opening 60 substantially parallel to the access opening the adjacent side wall 42 of the enclosure, the bottom panel 100 extends substantially vertically from proximate the bottom edge of the access opening, over the closed side panels, toward the upper edge of the access opening, and the top panel 70 extends substantially vertically and downwardly over the side panels toward the bottom panel. The top panel 70 and bottom panel 100 are latched together with means such as slide bolts 250 in a collapsed configuration so that the access opening 60 remains securely closed.

When service of equipment inside the utility enclosure 10 is required, the fold-out rooms 12 can be opened to the expanded configuration, such as in FIG. 1, so that work can be conducted on equipment inside the enclosure while service personnel are protected in the fold-out room. The fold-out room 12 is opened by first unlatching the top and bottom panels 70 and 100 and raising the top panel from the closed position against the side panels 120 and 140 to the extended position wherein the top panel is substantially perpendicular to the access opening 60 and the adjacent side wall 42 of the enclosure. The pneumatic cylinders 90 lock the top panel 70 in the extended position. The bottom panel 100 is lowered from the closed position, wherein the bottom panel is against the closed side panels 120 and 140, to the extended position, wherein the bottom panel extends perpendicularly from the access opening 60 and the adjacent side wall 42 of the enclosure and rests on top of the support blocks 112. Next, the side panels 120 and 140 are opened from the closed position covering the access opening 60 to their extended position wherein the side panels are substantially perpendicular to the access opening and the adjacent side wall 42 of the enclosure and the side walls extend substantially perpendicularly between the top panel 70 and the bottom panel 100. The side panels 120 and 140 are secured to the top panel 70 and bottom panel 100 with the latches 230. Lastly, the rear panels 190 and 200 are shifted from their closed position against the side panels 120 and 140 to their first extended position to fully enclose the fold-out room. The rear panels 190 and 200 can be moved to the second extended position to move in and out of the enclosed space within the fold-out room 12.

The fold-out rooms 12 protect service personnel and equipment from the elements such as heat, cold, rain, and snow while servicing equipment within the utility enclosure 10. Because the fold-out rooms 12 are substantially completely enclosed, the fold-out rooms are climate controlled by the air conditioning units 65 of the utility enclosure.

Desirably, the utility enclosure 10 is sized to occupy a minimum space so that the utility room can be positioned in a variety of locations and occupies minimum real estate. Accordingly, the exterior shell 30 of the utility enclosure 10 is sized to be just large enough to contain the necessary equipment. With the fold-out rooms 12, the utility enclosure 10 can be sized just large enough to house the necessary equipment but still provide cover during servicing of the equipment in the enclosure. The fold-out rooms 12 occupy a larger space than that occupied by the utility enclosure 10 only during periods of service, which are rather infrequent and short, typically from 15 minutes to an hour. The small size of the utility enclosure 10 is advantageous because it allows installation of cellular telephone equipment sites in small places such as billboards, on light poles, and existing towers which have equipment space limitations. Furthermore, the cost of air conditioning to cool the equipment housed in the enclosure is substantially reduced due to the size and compact design of the enclosure. The size of the utility enclosure is desirably four feet wide and ten feet long.

The top panel 70, bottom panel 100, side panels 120 and 140 and rear panels 190 and 200 of the fold-out rooms 12 desirably are made of rigid material such as metal, wood, or plastic or the like. Desirably, the panels are made of a lightweight metal such as aluminum with at least some of the panels being insulated. Lightweight, but heavy gauge aluminum panels with foam insulation board are preferred materials for the panels.

Alternatively, the side panels 120 and 140 and the rear panels 190 and 200 can be made of flexible material such as plastic sheeting or canvas or the like. In such an embodiment, the flexible material can be attached to the top panel 70 and, optionally, the bottom panel 100 with fastening devices such as snaps or hook-and-loop fasteners.

Other objects, features, and advantages of the above-described invention will be appreciated by those skilled in the art. In particular, it should be appreciated that the panels of the fold-out room can be arranged in a variety of hinged configurations and still achieve the objects of this invention.

It should be understood that the foregoing relates to particular embodiments of the present invention, and that numerous changes may be made therein without departing from the scope of the invention as defined by the following claims.

We claim:

1. A cell site comprising an enclosure, an auxiliary fold-out room adjacent the enclosure, and cellular communication equipment disposed in the enclosure, the enclosure comprising an exterior shell defining an interior space containing the cellular communication equipment and having an access opening for providing access to the cellular communication equipment through the exterior shell, the fold-out room comprising a plurality of panels including a top panel, a pair of side panels, and a pair of rear panels and a plurality of hinges hingedly connecting the top panel and side panels to the exterior shell of the enclosure about the access opening and hingedly connecting each rear panel to a distal end of each side panel, the panels and hinges arranged so that the fold-out room is selectively positionable in a collapsed configuration and alternatively positionable in an expanded configuration, the panels and hinges arranged so that, in the collapsed configuration, the panels cover the access opening of the enclosure and lie against the enclosure parallel to the access opening, the panels and hinges further arranged so that, in the expanded configuration, the panels cover the access opening and define an enclosed space adjacent the access opening and outside the adjacent enclosure, and provide ingress and egress to the fold-out room from outside of the enclosure.

2. An enclosure as in claim 1 wherein the enclosure is a utility enclosure containing cellular communication equipment.

3. A cell site as in claim 1 wherein the plurality of panels form a box-shaped auxiliary fold-out room in the expanded configuration.

4. A cell site as in claim 3 wherein the plurality of panels further include a bottom panel which forms a floor of the auxiliary fold-out room in the expanded configuration.

5. A cell site as in claim 3 wherein:

the top panel is pivotally connected to the shell of the enclosure above the access opening so that, in the collapsed configuration, the top panel extends downwardly over at least a portion of the access opening, and, in the expanded configuration, the top panel extends outwardly from the shell of the enclosure to form a roof of the auxiliary fold-out room;

the pair of side panels are pivotally connected to the shell of the enclosure along respective opposing side edges of the access opening so that, in the collapsed configuration, the side panels extend toward one another over the access opening, and, in the extended configuration, the side panels extend substantially perpendicularly and outwardly from the access opening to form side walls of the auxiliary fold-out room; and the pair of rear panels are arranged so as to form a rear wall of the auxiliary fold-out room between the pair of side panels in the extended configuration.

6. A cell site as in claim 5 wherein the pair of rear panels are pivotally connected to distal ends of respective ones of the side panels so that, in the collapsed configuration, the pair of rear panels fit against the respective ones of the side panels, and, in the extended configuration, the pair of rear panels extend inwardly toward one another to form the rear wall of the auxiliary fold-out room.

7. A cell site as in claim 6 wherein the plurality of panels further include a bottom panel pivotally connected to the shell of the enclosure below the access opening so that the bottom panel, in the collapsed configuration, extends toward the top panel over the access opening, and, in the extended configuration, extends outwardly and perpendicularly from the access opening, and, in the extended configuration, extends outwardly and perpendicularly from the access opening to form a floor of the auxiliary fold-out room.

8. A cell site as in claim 1 wherein the plurality of panels are rigid.

9. A cell site as in claim 3 wherein the top panel, the side panels, and the rear panels are composed of rigid material.

10. A cell site as in claim 3 wherein the top panel and the side panels are composed of rigid material and the rear panels are composed of flexible material.

11. A cell site as in claim 5 wherein the top panel, the side panels, and the rear panels are composed of rigid material.

12. A cell site as in claim 5 wherein the top panel and the side panels are composed of rigid material and the rear panels are composed of flexible material.

13. A cell site as in claim 3 further comprising a means for locking the top panel in the extended configuration.

14. A cell site as in claim 13 wherein the locking means comprises a pneumatic cylinder.

15. A cell site as in claim 3 further comprising latches for engaging the pair of side panels with the top panel in the extended configuration.

16. A cell site as in claim 4 further comprising a latch for engaging the top panel with the bottom panel in the collapsed configuration.

17. A cell site as in claim 1 wherein at least one of the panels serves as a door for ingress and egress to the fold-out room.

18. A cell site as in claim 3 wherein at least one of the rear panels serves as a door for ingress and egress to the fold-out room.

19. A cell site comprising an enclosure, a pair of auxiliary fold-out rooms adjacent the enclosure, and cellular communication equipment disposed in the enclosure, the enclosure comprising a roof, opposing side walls, and opposing end walls arranged in a box shape and defining an interior space containing the cellular communication equipment, the enclosure having, a first access opening, in one of the opposing side walls and a second access opening in the other of the opposing side walls for providing access to the cellular communication equipment through the opposing side walls, one of the fold-out rooms connected to one of the opposing side walls and another of the fold-out rooms connected to the other of the opposing side walls, each fold-out room comprising a plurality of panels including a top panel, a pair of side panels, and a pair of rear panels and a plurality of hinges hingedly connecting the top panel and side panels to the respective side wall of the enclosure about the respective access opening and hingedly connecting each rear panel to a distal end of each side panel, the panels and hinges arranged so that each fold-out room is selectively positionable in a collapsed configuration and alternatively positionable in an expanded configuration, the panel and hinges arranged so that, in the collapsed configuration, the panels cover the respective access opening and lie against the enclosure parallel to the respective access opening, the panels and hinges further arranged so that, in the expanded configuration, the panels cover the respective access opening and define an enclosed space adjacent the respective access opening and outside the adjacent enclosure, and provide ingress and egress to the fold-out room from outside of the enclosure.

20. An enclosure as in claim 19 wherein the enclosure is a utility enclosure containing cellular communication equipment.

21. A cell site as in claim 18 wherein at least one of the panels of each fold-out room serves as a door for ingress and egress to each fold-out room.

22. An auxiliary fold-out room for an adjacent cell site, the cell site comprising an exterior shell defining an interior space containing cellular communication equipment and having an access opening for providing access to the interior space through the exterior shell, the fold-out room comprising a plurality of panels including a top panel, a pair of side panels, and a pair of rear panels and a plurality of hinges for hingedly connecting the top panel and side panels to the exterior shell of the cell site about the access opening a hingedly connecting each rear panel to a distal end of each side panel, the panels and hinges arrangeable so that the fold-out room is selectively positionable in a collapsed configuration and alternatively positionable in an expanded configuration, the panels and hinges arrangeable so that, in the collapsible configuration, the panels cover the access opening of the cell site and lie against the cell site parallel to the access opening, the panels and hinges further arranged so that, in the expanded configuration, the panels cover the access opening and define an enclosed space adjacent the access opening and outside the adjacent cell site, and provide ingress and egress to the fold-out room from outside of the cell site.

23. An auxiliary fold-out as in claim 22 wherein at least one of the panels serves as a door for ingress and egress to the fold-out room.

24. An enclosure with an adjacent auxiliary fold-out room, the enclosure comprising an exterior shell defining an interior space and having an access opening for providing access to the interior space through the exterior shell, the fold-out room comprising a plurality of panels and a plurality of hinges hingedly connecting at least some of the panels to the exterior shell of the enclosure about the access opening, the panels and hinges arranged so that the fold-out room is selectively positionable in a collapsed configuration and alternatively positionable in an expanded configuration, the panels and hinges arranged so that, in the collapsed configuration, the panels cover the access opening of the enclosure and lie against the enclosure parallel to the access opening, the panels and hinges further arranged so that, in the expanded configuration, the panels cover the access opening and define an enclosed space adjacent the access opening and outside the adjacent enclosure, and provide ingress and egress to the fold-out room from outside of the enclosure, the panels and hinges further arranged so that the panels are capable of being expanded by first raising a top panel to form a roof, then lowering a bottom panel to form a floor, opening two side panels from a closed position covering the access opening to a position perpendicular to the access opening, and shifting two rear panels from their closed position against the side panels to an extended position to fully enclose the fold-out room.

25. An enclosure as in claim 24 wherein at least one of the rear panels serves as a door for ingress and egress to the fold-out room.

* * * * *